US007966672B1

(12) United States Patent
Hagerman et al.

(10) Patent No.: US 7,966,672 B1
(45) Date of Patent: Jun. 28, 2011

(54) CLOTHING WITH SPECIAL ACCESS

(76) Inventors: Monica Hagerman, Shelbyville, KY (US); Dora Kathleen Haughn, Shelbyville, KY (US)

( * ) Notice: Subject to any disclaimer, the term of this patent is extended or adjusted under 35 U.S.C. 154(b) by 113 days.

(21) Appl. No.: 12/409,650

(22) Filed: Mar. 24, 2009

Related U.S. Application Data

(60) Provisional application No. 61/056,579, filed on May 28, 2008.

(51) Int. Cl.
*A41D 1/06* (2006.01)
*A41D 13/02* (2006.01)
*A41D 3/02* (2006.01)

(52) U.S. Cl. ..... 2/227; 2/86

(58) Field of Classification Search ..... 2/70, 71, 2/79, 231, 227, 232, 269, 270, 86, 114
See application file for complete search history.

(56) References Cited

U.S. PATENT DOCUMENTS 1,771,916 A * 7/1930 Cowen ..... 2/227
2,236,636 A * 4/1941 Young ..... 2/227
3,389,407 A * 6/1968 Morrison ..... 2/84
3,801,986 A * 4/1974 Purdon ..... 2/69
4,308,622 A * 1/1982 Maddron ..... 2/79
4,457,025 A 7/1984 Meryash
4,535,480 A 8/1985 Kunieda
4,667,344 A * 5/1987 Cooper, III ..... 2/79
4,835,795 A 6/1989 Lonon
4,914,756 A * 4/1990 Grassick ..... 2/227
4,961,234 A 10/1990 Leibman
5,163,182 A 11/1992 Fiveash
5,208,918 A * 5/1993 Royal ..... 2/114
5,222,258 A * 6/1993 Mucci et al. ..... 2/114
5,473,780 A 12/1995 Zen
5,611,082 A * 3/1997 Bull ..... 2/79
5,717,998 A 2/1998 Everett et al.
5,802,611 A * 9/1998 McKenzie et al. ..... 2/69
5,896,581 A 4/1999 Wong
6,016,569 A 1/2000 Everett et al.
6,026,516 A 2/2000 Dacyshyn
6,260,209 B1 * 7/2001 St. Ange ..... 2/227
6,324,699 B1 12/2001 Cosmah
6,477,711 B1 11/2002 Freeman et al.
6,477,716 B2 * 11/2002 Blaire ..... 2/227
7,032,249 B2 4/2006 Smith
D575,028 S * 8/2008 Patton ..... D2/742
7,454,798 B2 * 11/2008 Feodoroff ..... 2/114
D605,833 S * 12/2009 Pippin et al. ..... D2/742

* cited by examiner

*Primary Examiner* — Alissa L Hoey
*Assistant Examiner* — Amber R Anderson
(74) *Attorney, Agent, or Firm* — Camoriano and Associates; Theresa Fritz Camoriano

(57) ABSTRACT

A garment includes a special access mechanism to enable the inseam to be opened and the legs to be fastened to the main body portion in a raised position.

7 Claims, 3 Drawing Sheets

CLOTHING WITH SPECIAL ACCESS

This application claims priority from U.S. Provisional Application Ser. No. 61/056,579 filed May 28, 2008, which is hereby incorporated herein by reference.

BACKGROUND

The present application relates to an article of clothing, and, in particular, to clothing with special access.

Often, a person who is wearing coveralls or overalls must remove the entire garment in order to use the toilet. This can create an inconvenience for the wearer.

SUMMARY

The present invention provides special access which enables the wearer to have access to the legs and crotch area and to use the restroom without having to remove the garment.

DETAILED DESCRIPTION

Figure 1:
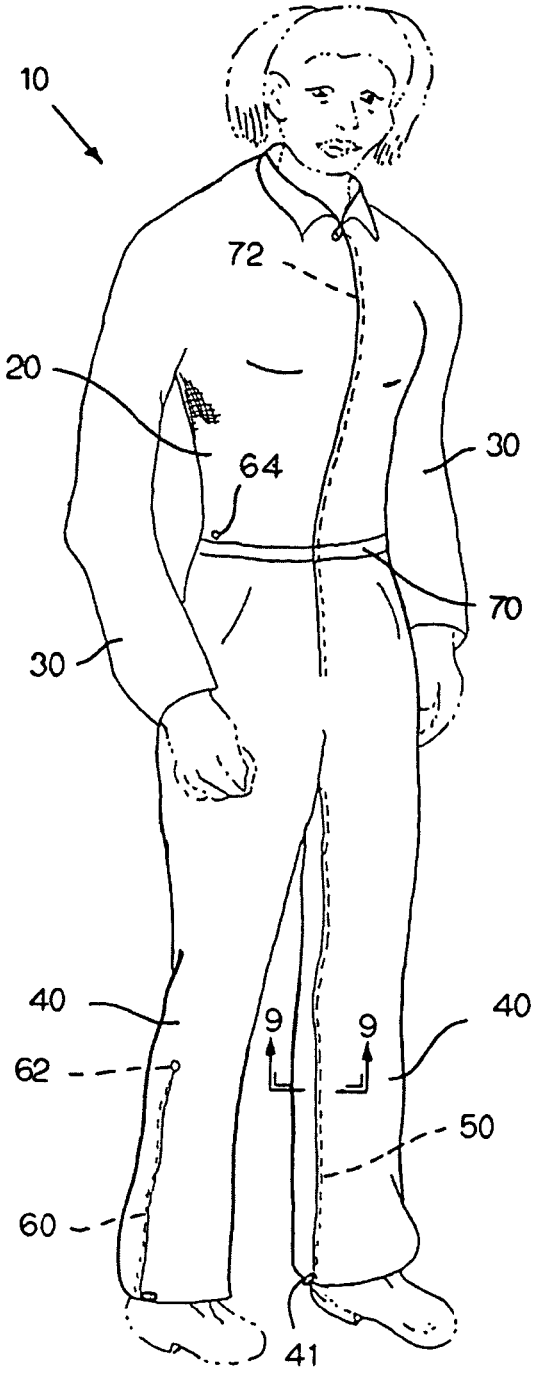
FIG. 1 is a front view of a pair of zipped-up coveralls as viewed from the right side of the wearer.

FIGS. 1-6 depict an embodiment of coveralls 10 including a main body 20, sleeves 30, and leg portions 40. The leg portions 40 extend downwardly from the main body 20 and are connected together at a crotch portion. An inseam zipper 50 extends continuously from the bottom edge 41 of the left leg portion 40, up along the crotch and down to the bottom edge 41 of the right leg portion 40 along the inseam. Each leg 40 also includes an outer zipper 60 parallel to and opposite to the inseam zipper 50, extending along the outer seam from the bottom edge 41 of the leg 40 to calf-height or just below knee-height to aid in donning/removing footgear. The inseam zipper 50 is an open-ended zipper which uses a "box and pin" mechanism to lock the two sides of the zipper into place, the same type as is often used in jackets, so its two sides can be completely separated when the zipper is opened.

Figure 9:
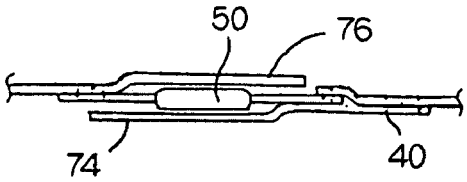
FIG. 9 is a section view along line 9-9 of FIG. 1.

FIG. 9 shows a section along line 9-9 of FIG. 1, through the inseam zipper 50. It may be observed that the inseam zipper 50 is attached to both the front and rear sides of the leg portion 40, and that there is an outer flap 74 covering the outer surface of the zipper 50 and an inner flap 76 covering the inner surface of the zipper 50. The inner flap 76 protects the wearer's skin or inner garments from getting caught on the zipper 50 as it is being opened or closed. The outer flap 74 also protects the zipper 50 from catching on something, as well as providing an aesthetically finished look to the garment 10. Both the inner and outer flaps 76, 74 also provide a windbreak to prevent breezes from blowing through the zipper. The other zippers 60, 72 also are installed in a similar arrangement, having inner and outer flaps. It would be possible to eliminate one or both of the flaps 76, 74, if desired, in order to reduce bulk.

Figure 2:
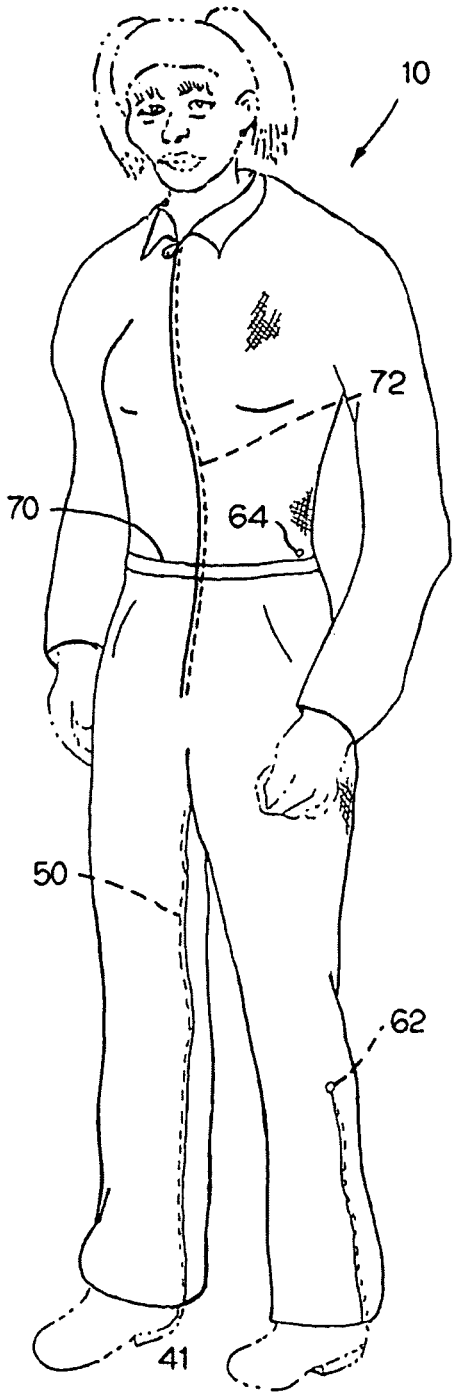
FIG. 2 is a front view of the zipped-up coveralls as viewed from the left side of the wearer.
Figure 3:
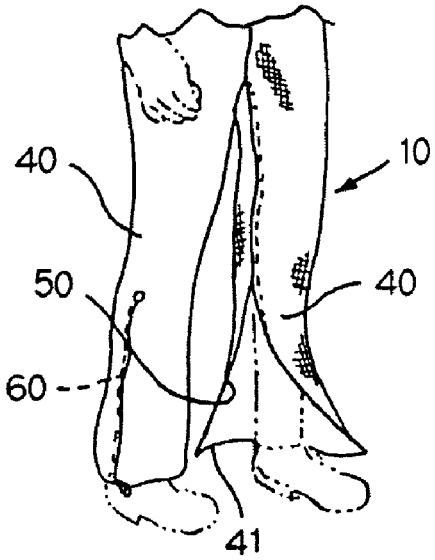
FIG. 3 is another view of the coveralls of FIG. 1, showing the inseam zipper being unzipped along the left leg.
Figure 4:
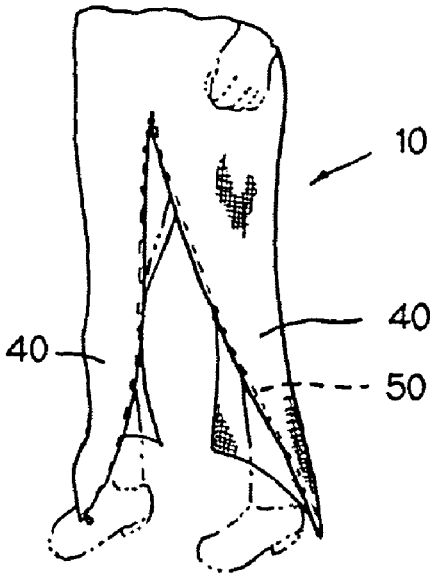
FIG. 4 is another view of the coveralls of FIG. 3, but after the inseam zipper has been completely unzipped along both legs.

FIGS. 1 and 2 depict the inseam zipper 50 in an initial fully closed position. FIG. 3 shows the inseam zipper 50 as it is being opened up the left leg of the wearer. FIG. 4 depicts the inseam zipper 50 in the completely open position, up the left leg, around the crotch area, and down the right leg of the wearer, leaving the front and back sides of the inseam completely separated from each other and providing full access to the legs and crotch area.

Figure 5:
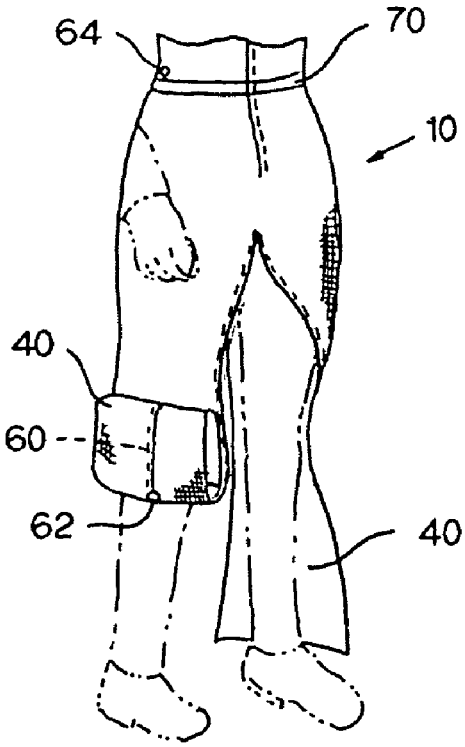
FIG. 5 is the same view as FIG. 4, but with the wearer having partially rolled up the right leg of the coveralls.
Figure 6:
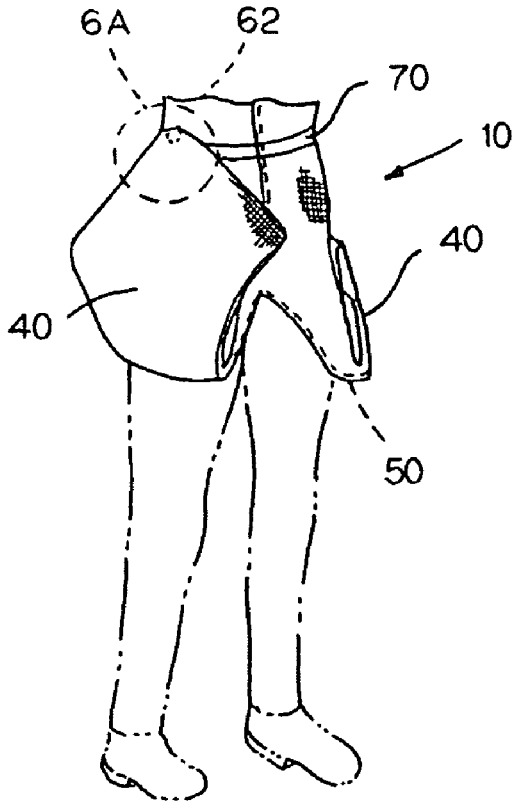
FIG. 6 is the same view as FIG. 5, but showing both legs of the coveralls fully rolled up and fastened.
Figure 6A:
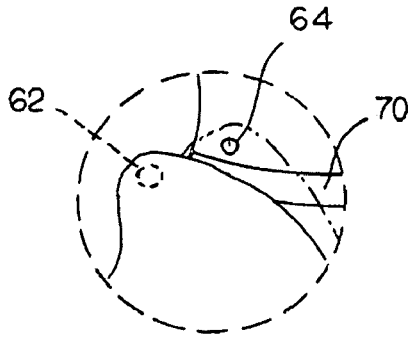
FIG. 6A is a detail view of an inner leg snap on the interior of the right leg and a mating outer snap on the outside of the waistband of the coveralls.

FIGS. 5 and 6 depict the process of rolling up the unzipped leg portions and fastening them to the main portion 20 to get them up out of the way. As shown in FIG. 5, there is a snap 62 having its functional side on the inner surface of the leg portion 40 just above the outer leg zipper 60. There is a corresponding snap 64 on the outer surface of the main body 20 just above the waistband, which mates with the snap 62 on the leg portion 40, functioning as a fastener means to fasten the leg portion 40 in a raised position so it is up and out of the way. FIG. 6A is an enlarged view showing the mating inner snap 62 and outer snap 64 located on the right side of the garment. The left side has a similar arrangement.

In order to get the leg portion 40 up and out of the way, the wearer first pulls the unzipped leg portion 40 out to flatten it, as shown on the left leg of the wearer in FIG. 5. Then he or she rolls it up from the bottom (as shown on the right leg of the wearer in FIG. 5) until the inner snap 62 is exposed. Then he or she grasps the inner snap 62 on the leg and snaps it into the mating outer snap 64 located on the main body 20 just above the waistband 70, so the leg portion 40 is fastened in its raised position, as shown in FIG. 6. The same process is repeated for the other leg portion, so both leg portions 40 are fastened in a raised position. This enables the wearer to use the toilet without the leg portions 40 falling into the toilet or dragging along the floor. FIG. 6 shows both left and right leg portions 40 in the raised and fastened position.

Figure 7:
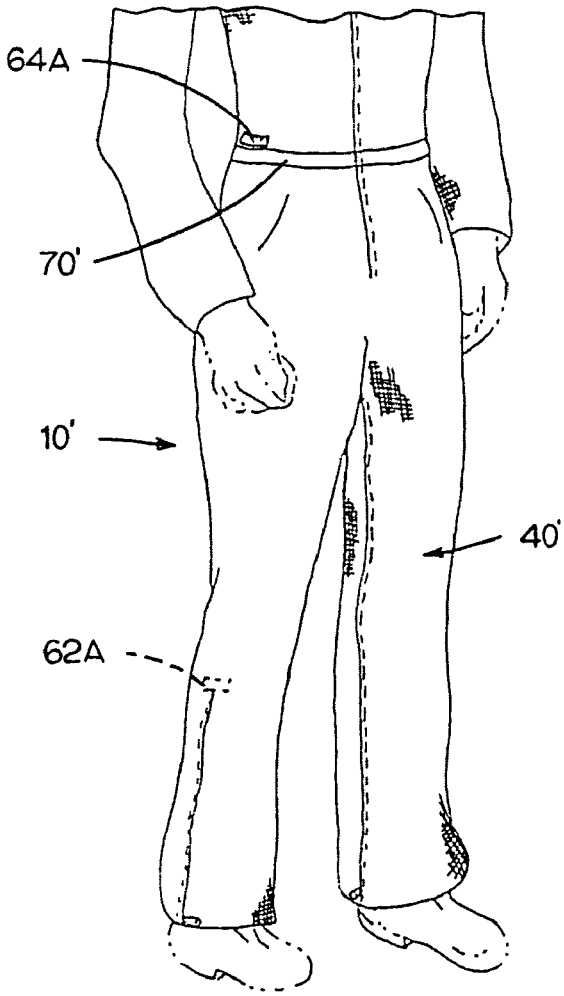
FIG. 7 is a front view of another embodiment of zipped-up coveralls as viewed from the right side of the wearer.
Figure 8:
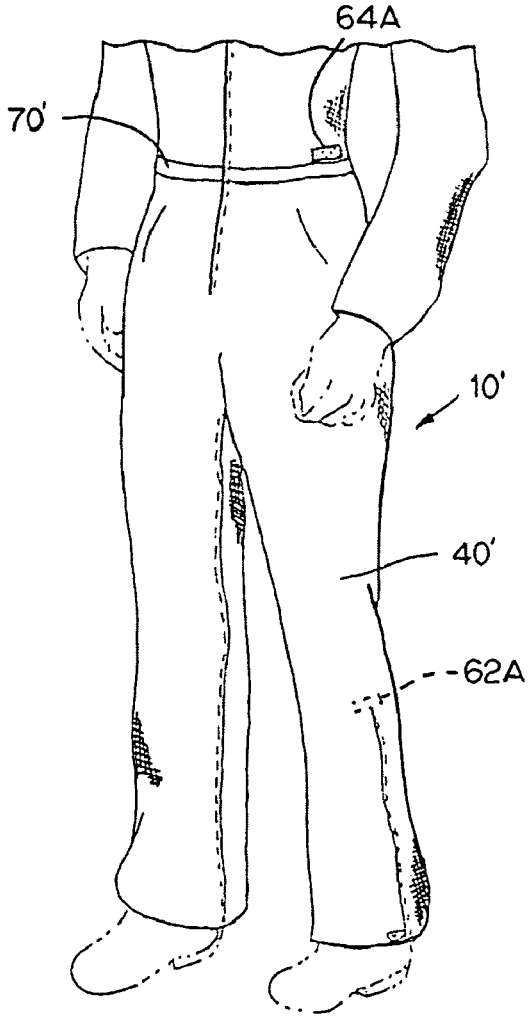
FIG. 8 is a front view of the zipped-up coveralls of FIG. 7, as viewed from the left side of the wearer.

FIGS. 7 and 8 show a pair of coveralls 10' that is identical to the coveralls 10 of FIGS. 1-6 except that mating hook-and-loop fasteners 62A, 64A are used instead of the snaps 62, 64. As with the snaps 62, 64, the leg portion 62A of the hook-and-loop fastener is located on the inner surface of the leg portion 40' about one-third of the distance from the bottom edge of the leg portion 40' to the waistband 70' (in the calf area or just below the knee). As with the first embodiment, the leg portion 40' below the inner fastener 62A is rolled or folded up to reach the inner fastener 62A, and then the inner fastener 62A is fastened to its mating outer fastener 64A located on the main body 20 in the waist or hip area. If it is desired to raise the leg 40' higher, the inner fastener 62A may be located at a higher position along the leg portion 40', or there may be multiple inner fasteners 62A at different heights along the leg portion 40', which would enable the wearer to choose which fastener to use in order to raise the leg the desired amount. Also, while the outer fastener 64A in this embodiment is in the waist or hip area, it alternatively may be located at a higher elevation, if desired, such as, for example, halfway between the armhole and the waist.

FIGS. 1 and 2 show the front zipper 72 of the coveralls 10, which is used to secure the garment onto the person. In order to put on the coveralls 10, the person unzips the front zipper 72, inserts his or her legs into the left and right leg portions 40, pulls up the coveralls 10, inserts his or her arms into the sleeves, and then zips up the front zipper 72, securing the coveralls 10 on himself or herself. It is not necessary to unzip the zipper 72 or to pull down the coveralls 10 in order to access the crotch area when the inseam zipper 50 is used, as described above.

This same arrangement could be used with a pair of bib overalls, which is similar to coveralls except that it does not have sleeves. In that case, the overalls are secured onto the person by securing the shoulder straps in place. Again, if the inseam zipper 50 were used, the wearer could access the crotch area without having to remove the overalls or unhook the shoulder straps.

The coveralls 10 or other garment may be made of any desired material, lined or unlined, heavy-weight, light-weight, waterproof, work-wear, hunting wear, ski wear, short-sleeved, long-sleeved, sleeveless, and so forth. The fasteners that fasten the leg portions to the body portion could be something other than the types of fasteners that are shown here, such as, for example, a loop and button.

It will be obvious to those skilled in the art that many modifications may be made to the embodiments described above without departing from the scope of the present invention as claimed.

What is claimed is:

1. A garment, comprising:

a main body portion having an outer surface;

left and right elongated leg portions having an interior surface and an exterior surface and extending downwardly from the main body portion to a bottom edge at ankle length, said left and right leg portions being connected together at a crotch portion;

an inseam zipper extending from the bottom edge of the left leg portion through the crotch portion to the bottom edge of the right leg portion;

fastener means on said left and right leg portions and corresponding left and right fastener means on said main body portion for fastening the left and right leg portions to the main body portion in a raised position when the inseam zipper is unzipped; wherein said fastener means on the left and right leg portions have their functional side on the interior surface and are located a distance above the bottom edge which is at least as great as calf height and are located substantially opposite said inseam zipper; and wherein said corresponding left and right fastener means on said main body portion have their functional side on the outer surface.

2. A garment as recited in claim 1, wherein said fastener means include a snap on each of said left and right leg portions, and left and right mating snaps on said main body portion.

3. A garment as recited in claim 2, wherein the garment includes a waist line and the mating left and right snaps on the main body portion are above the waist line.

4. A garment as recited in claim 1, wherein said fastener means include a hook-and-loop fastener on each of said left and right leg portions, and mating left and right hook-and-loop fasteners on said main body portion.

5. A garment as recited in claim 4, wherein the garment includes a waist line and wherein the mating left and right hook-and-loop fasteners on the main body portion are above the waist line.

6. A garment as recited in claim 1, wherein said garment further comprises an outer zipper on each of said left and right leg portions extending parallel to and opposite the inseam zipper and extending upwardly from the bottom edge.

7. A garment, comprising:

a main body portion having an outer surface;

left and right elongated leg portions having an interior surface and an exterior surface and extending downwardly from the main body portion to a bottom edge, said left and right leg portions being connected together at a crotch portion;

an inseam zipper extending from the bottom edge of the left leg portion through the crotch portion to the bottom edge of the right leg portion;

fastener means on said left and right leg portions and corresponding left and right fastener means on said main body portion for fastening the left and right leg portions to the main body portion in a raised position when the inseam zipper is unzipped; wherein said fastener means on the left and right leg portions have their functional side on the interior surface and are located a distance above the bottom edge which is at least as great as calf height and are located substantially opposite said inseam zipper;

wherein said garment further comprises an outer zipper on each of said left and right leg portions extending parallel to and opposite the inseam zipper and extending upwardly from the bottom edge; and wherein said left and right fastening means on said leg portions are located above the respective outer zippers.

* * * * *